US005241725A

United States Patent [19]

Hamatani et al.

[11] Patent Number: 5,241,725

[45] Date of Patent: Sep. 7, 1993

[54] SELF-ALIGNING AIRCRAFT DOOR STOP PIN ASSEMBLY

[75] Inventors: Tomio Hamatani, Seattle; John A. Meisch, Lynnwood, both of Wash.

[73] Assignee: The Boeing Company, Seattle, Wash.

[21] Appl. No.: 905,264

[22] Filed: Jun. 26, 1992

[51] Int. Cl.[5] ..... E05F 5/02

[52] U.S. Cl. ..... 16/82; 16/86 A

[58] Field of Search ..... 16/82, 83, 84, 85, 86 R, 16/86 A

[56] References Cited

U.S. PATENT DOCUMENTS

| | | | |
|---|---|---|---|
| 1,828,120 | 10/1929 | Perry . | |
| 1,835,775 | 3/1930 | May . | |
| 1,871,566 | 8/1930 | Stephens . | |
| 1,947,524 | 7/1932 | Horldt | 16/85 |
| 2,109,228 | 8/1937 | Carlson | 16/86 |
| 2,454,414 | 5/1945 | Taylor | 292/70 |
| 2,715,242 | 10/1951 | Smith | 16/86 |
| 2,933,754 | 5/1957 | Winans | 16/42 |
| 3,141,188 | 11/1960 | Gray | 16/86 |
| 3,187,372 | 2/1963 | Parsons | 16/137 |
| 3,243,836 | 4/1966 | Reiss | 16/85 |
| 3,956,930 | 5/1976 | Shoberg | 73/133 R |
| 4,159,837 | 7/1979 | Morita | 16/85 |
| 4,310,269 | 1/1982 | Neu | 408/11 |
| 4,440,529 | 4/1984 | Henslee | 408/1 R |
| 5,010,622 | 4/1991 | Morita | 16/85 |

*Primary Examiner*—W. Donald Bray

*Attorney, Agent, or Firm*—Conrad O. Gardner; B. A. Donahue

[57] ABSTRACT

A self-aligning aircraft door stop pin assembly, which minimizes galling and compensates for misalignment problems. The assembly consists of a base pad containing a concave spherical recess, which is swaged onto the convex spherical head at one end of a threaded stop pin. The base pad is free to align, so as to make full face contact with the structural stop pad. The sperical interface between stop pin and base pad is provided with lubrication, on one or both parts.

5 Claims, 2 Drawing Sheets

SELF-ALIGNING AIRCRAFT DOOR STOP PIN ASSEMBLY

BACKGROUND OF THE INVENTION

This invention relates to an aircraft door stop, and more particularly to a door stop pin assembly for alleviating galling, overstressing, and misalignment problems.

As a result of normal assembly operations for door stop fittings, there is a small angular misalignment between pairs of mating stop fittings, i.e., the axis of the stop pad is not parallel to the axis of the stop pin. The problems related to this geometric condition depends upon what type of stop pin is being considered: (a) for a stop pin with a large head radius, it means that the "point" of contact will not be located on the axis of the stop pin. There will still be a "point" contact, and if stresses are high enough, galling will occur; (b) for a stop pin with a flat head, the flat surface of the head will not make full contact, but instead will make contact at some point along the bottom edge. Again, if the stresses are high enough, galling will occur.

Galling is an undesirable development and is a bearing stress problem. Advanced stages of galling can result in excessive resistance to the lateral sliding of the stop pin on the stop pad. This large lateral load contributes toward fatigue failure of door stop fittings. Both types of existing pins, (a) and (b) above, can lead toward fatigue failure of the door stop fittings due to galled surfaces.

In the patent literature, U.S. Pat. No. 3,187,372 to Parsons, issued Jun. 8, 1965, discloses a self-aligning pin to accommodate the change in geometry of the stop assembly, in contrast to the present invention which provides means for transferring high loads between two elements of structure that may not be disposed precisely ninety degrees with respect to each other. The present preferred embodiment of the invention accommodates relative motion between the self-aligning stop pin assembly and its mating stop pad.

Returning to the stop pin discussed in (a) hereinabove, in sum it can be stated that angular misalignment of the stop fittings has very little, if any, effect upon the development of galling. Even with perfect alignment, there will be a "point" contact between the pin and the pad. In (b) discussed hereinabove, a different situation exists In this case, the misalignment directly contributes to the development of galling by initiating a "point" contact condition.

Having understood the preceding discussion, there is one other aspect requiring explanation regarding the misalignment of the door stop fittings. Since the stop pad surface will usually be abnormal to the axis of the stop pin, this means that on occasion the tilt of the stop Pad will be such that in order for the stop pin to slide in its preferred lateral direction, the pin will need to slide "uphill." To slide uphill requires that the pin accept more axial compressive load. The tendency of the pin is to resist this "uphill" movement and instead of sliding, the pin transfers its lateral resistance load to its own fitting. In a situation such as this, the self-aligning device, according to the preferred embodiment of the present invention, does very little to reduce the magnitude of the lateral loads exerted upon the pin fitting; however, its redeeming feature is that it will help inhibit the development of galling, and thus prevent the increase in magnitude of the lateral loads acting on the pin fitting that would be associated with advanced galling.

The majority of Prior attempts to reduce the lateral loads transferred to the door stop fittings have been related to reducing the sliding friction forces between the pin and the pad utilizing various lubricants. In spite of these efforts, problems related to galling still occur.

SUMMARY OF THE INVENTION

The present stop pin assembly is intended to guarantee uniform, low level bearing stresses between the base pad and the stop pad, thus eliminating the development of galled surfaces, and the associated large lateral loading of the door stop fitting. The device is a self-aligning stop pin assembly. The self-aligning feature thus guarantees that the load is distributed uniformly between the rod and the base pad within the full operational motion envelope of the device. This device, by nature of its variable position base pad, is capable of accommodating the expected small angular misalignments of the door stop fittings. The base pad therefore transfers the load to the stop pad surface, and since the base pad maintains full contact against the stop pad, the bearing stresses are maintained at very low levels.

DETAILED DESCRIPTION OF THE DRAWINGS

Figure 1:
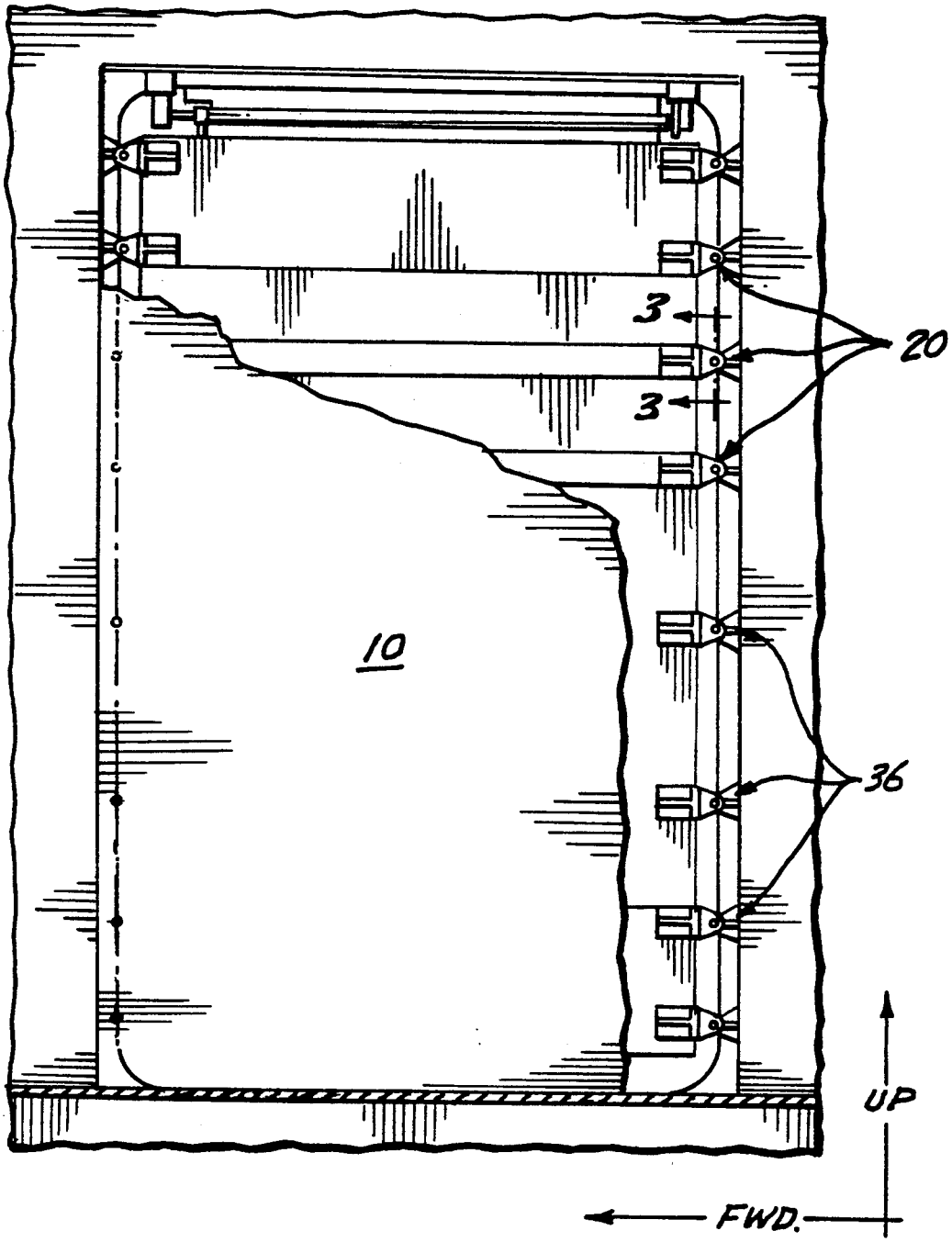
FIG. 1 is a vertical elevation of an aircraft cabin entry door with parts in section showing a plurality of locations of the present self-aligning aircraft door stop pin assemblies.
Figure 2:
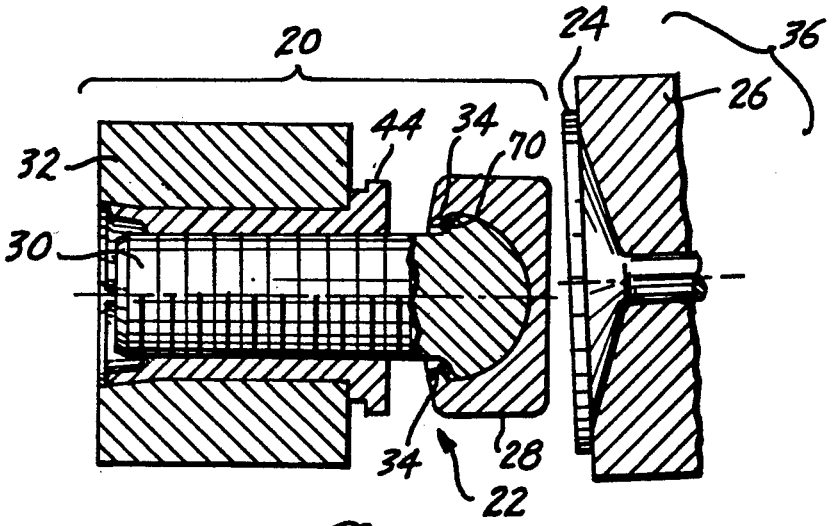
FIG. 2 is a vertical section of the present self-aligning aircraft door stop pin assembly with door in the closed, unpressurized position.
Figure 3:
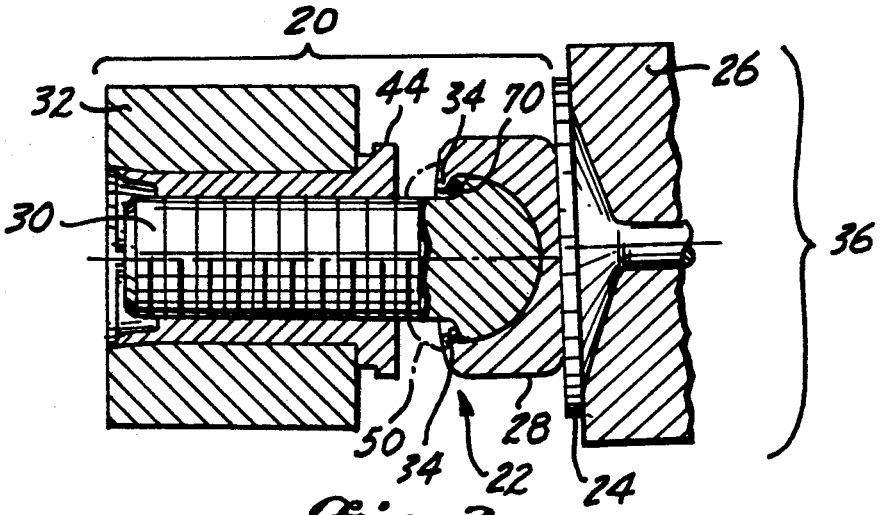
Figure 4:
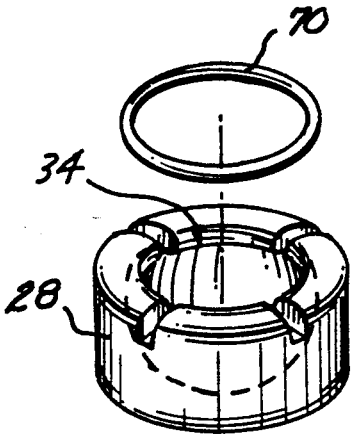
Figure 5:
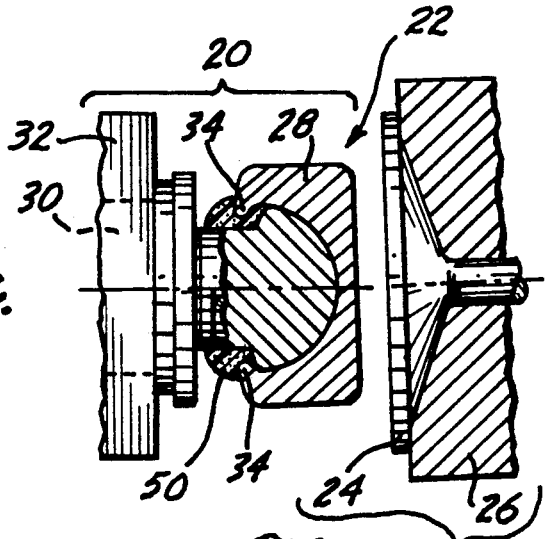

FIG. 3 is a vertical section of the present self-aligning aircraft door stop pin assembly taken along lines 3-3 of FIG. 1; however in contrast to FIG. 2, the door is shown in the closed, pressurized position, with the base pad 28 exerting its load on the stop pad 24;

FIG. 4 is an exploded isometric view of the present self-aligning aircraft door stop pin assembly subcombination base pad 28 and O-ring 70, prior to capture of the 0-ring; and, FIG. 5 is a sectional view illustrative of the optional use of sealant material to maintain the unloaded base pad in a position parallel to the stop pad.

DETAILED DESCRIPTION OF THE INVENTION

Turning now to FIG. 1, there is seen a passenger door 10 of an aircraft having a plurality of door stop assemblies 20. Typically, there are 16 door stop assemblies 20 per passenger door 10. Door stop assemblies 20 are shown in more detail in FIGS. 2–5. There are also 16 fuselage stop assemblies 36 to complement the door stop assemblies 20.

Door stop assembly 20, as seen in FIG. 2, comprises stop pin fitting 32 and self-aligning door stop pin assembly 22.

Fuselage stop assembly 36, as seen in FIG. 2 comprises stop pad 24 functioning as a bearing plate, and supported by stop pad fitting 26. Fuselage stop assembly 36 is not part of this invention.

Self-aligning door stop pin assembly 22 comprises a base pad 28 functioning as a bearing, base pad 28 having a concave spherical recess for receiving the convex spherical end surface of stop pin 30. Stop pin 30 is a rod threaded at the end opposite the convex spherical end, and retained in stop pin fitting 32 by means of threaded insert 44.

Base pad 28 is swaged onto the convex spherical end of stop pin 30 so that base pad 28 and the convex spherical end of stop pin 30 can rotate freely on their common lubricated mating spherical surfaces. The relative angular motion of the swaged parts is determined by the geometry of swaged lip portion 34 of base pad 28. An important advantage of door stop pin assembly 22 is that it allows base pad 28 to make full contact (as seen in FIG. 3) with stop pad 24, thereby maintaining low bearing stresses between stop pad 24 and base pad 28, and likewise between base pad 28 and the threaded rod comprising stop pin 30. This result is achieved even though there is slight axial misalignment between base pad 28 and stop pad 24.

In FIG. 3, base pad 28, functioning as a bearing, is shown in contact with stop pad 24, functioning as a bearing plate, accommodating a few degrees of misalignment. Also shown in FIG. 3 is the optional use (dotted line) of flexible sealant 50, which is utilized to prevent contaminant from entering the spherical interface, and also to maintain the flat surface of base pad 28 parallel to the surface of stop pad 24. 0-ring 70, retained by swaged lip portion 34 of base pad 28, is also shown in squeezed condition during misalignment.

FIG. 4 is illustrative of how base pad 28, functioning as a bearing, appears before it is swaged to capture 0-ring 70, and thereby provide an integral assembly of stop pin 30, base pad 2B, and 0-ring 70.

FIG. 5 shows how flexible sealant 50 acts, as hereinbefore mentioned, to maintain unloaded base pad 28 in a position parallel to the surface of stop pad 24.

The preceding embodiment of the invention is illustrative of an example of the invention which is defined in scope only by the claims.

What is claimed is:

1. A self-aligning door stop pin assembly for transferring loads between two elements of structure not disposed ninety degrees with respect to each other comprising:

a threaded stop pin having a convex spherical head on one end;

a base pad having a concave spherical recess and an upstanding lip for swaging;

said base pad lip swaged over said convex spherical end of said stop pin;

a structural stop pad;

said base pad fully alignable so as to make contact with said structural stop pad;

said base pad limiting the alignment motion of the swaged parts.

2. The invention according to claim 1 further including means for maintaining the central axis of said threaded stop pin at an angle of ninety degrees with respect to the bottom plane of said base pad.

3. The invention according to claim 2 wherein said means comprises an 0-ring retained by said swaged lip portion of said base pad.

4. The invention according to claim 2 wherein said means comprises a flexible sealant injected between said threaded stop pin and said swaged lip portion of said base pad.

5. The invention according to claim 1 further including means for maintaining the bottom plane of said base pad in position parallel to said stop pad.

* * * * *